US006398196B1

(12) United States Patent
Light et al.

(10) Patent No.: US 6,398,196 B1
(45) Date of Patent: Jun. 4, 2002

(54) STEAM HUMIDIFIER FOR FURNACES

(75) Inventors: Barry D. Light, Belton; Timothy W. Roberts, Raytown, both of MO (US)

(73) Assignee: Allied Systems Research, Inc., Belton, MO (US)

( * ) Notice: Subject to any disclaimer, the term of this patent is extended or adjusted under 35 U.S.C. 154(b) by 0 days.

(21) Appl. No.: 09/528,838

(22) Filed: Mar. 20, 2000

(51) Int. Cl.[7] ..... B01F 3/04

(52) U.S. Cl. ..... 261/130; 261/131; 261/137; 261/142; 261/39.1; 261/66; 126/113

(58) Field of Search ..... 261/39.1, 66, 115, 261/128, 129, 130, 131, 137, 142, DIG. 10, DIG. 15, DIG. 76; 126/113; 392/397

(56) References Cited

U.S. PATENT DOCUMENTS

| | | | | | |
|---|---|---|---|---|---|
| 903,150 | A | * | 11/1908 | Braemer | 261/129 |
| 1,101,902 | A | * | 6/1914 | Braemer | 261/128 |
| 3,215,416 | A | * | 11/1965 | Liben | 261/142 |
| 3,486,697 | A | * | 12/1969 | Fraser | 261/115 |
| 3,952,181 | A | * | 4/1976 | Reed | 261/130 |
| 4,213,433 | A | * | 7/1980 | Day | 261/142 |
| 4,257,389 | A | * | 3/1981 | Texidor et al. | 261/129 |
| 4,480,172 | A | * | 10/1984 | Ciciliot et al. | 261/142 |
| 4,564,746 | A | | 1/1986 | Morton et al. | |
| 4,692,591 | A | | 9/1987 | Fowler | |
| 4,705,936 | A | | 11/1987 | Fowler | |
| RE33,414 | E | | 10/1990 | Morton | |
| 5,126,080 | A | | 6/1992 | Morton et al. | |
| 5,203,505 | A | | 4/1993 | Yum | |
| 5,277,849 | A | | 1/1994 | Morton et al. | |
| 5,376,312 | A | | 12/1994 | Morton et al. | |
| 5,483,616 | A | | 1/1996 | Chiu et al. | |
| 5,516,466 | A | | 5/1996 | Schlesca et al. | |
| 5,543,090 | A | | 8/1996 | Morton et al. | |
| 5,758,018 | A | | 5/1998 | Fowler, Jr. | |
| 5,815,637 | A | | 9/1998 | Allen et al. | |
| 5,942,163 | A | | 8/1999 | Robinson et al. | |

* cited by examiner

*Primary Examiner*—C. Scott Bushey
(74) *Attorney, Agent, or Firm*—Hovey Williams LLP

(57) ABSTRACT

A steam humidifier for use with a forced air heating system includes a steam nozzle mounted in the plenum of the heating system and connected to a water feed line connected to a continuous pressurized water source. The water feed line is made of a thermal conducting material and is coiled about a heating element wherein the heating element and conductive coil are substantially surrounded by an insulation barrier. The water feed line is controlled by a solenoid operated valve that will be activated only when the heater is on and a humidistat detects that humidity is required by the area being serviced by the forced hot air system.

15 Claims, 4 Drawing Sheets

FIG. 2
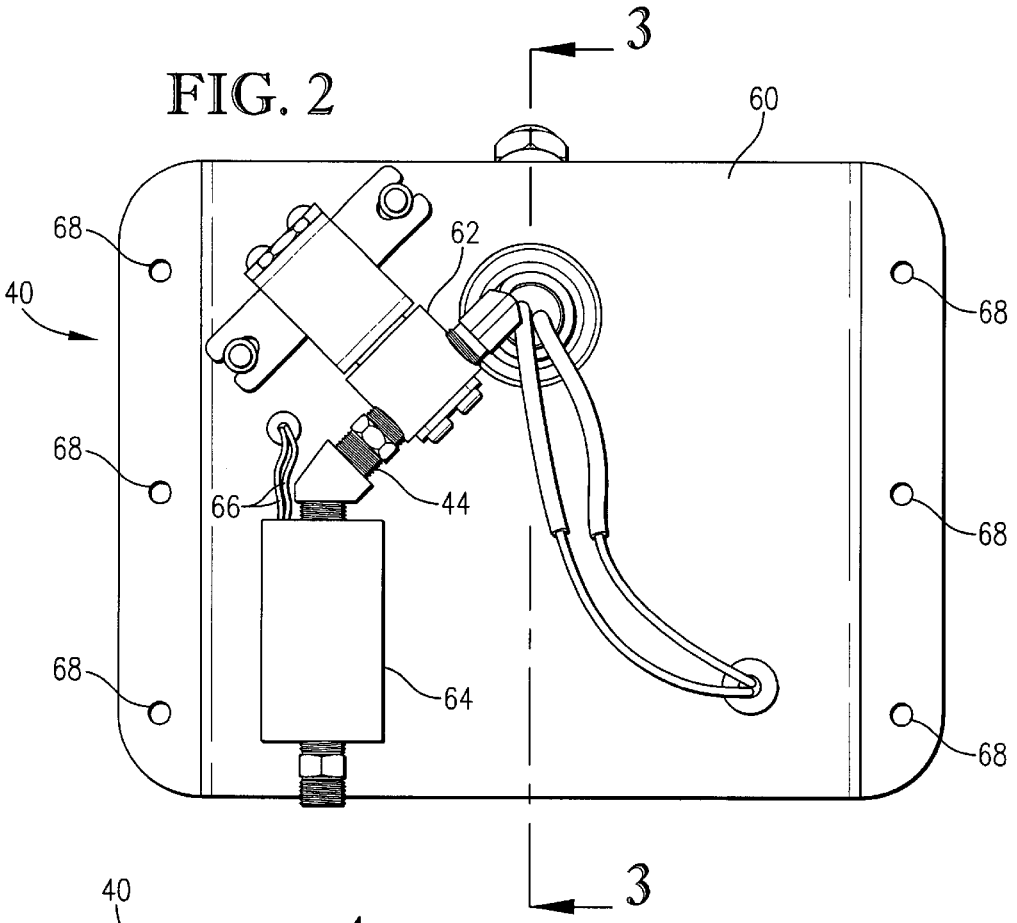
FIG. 3
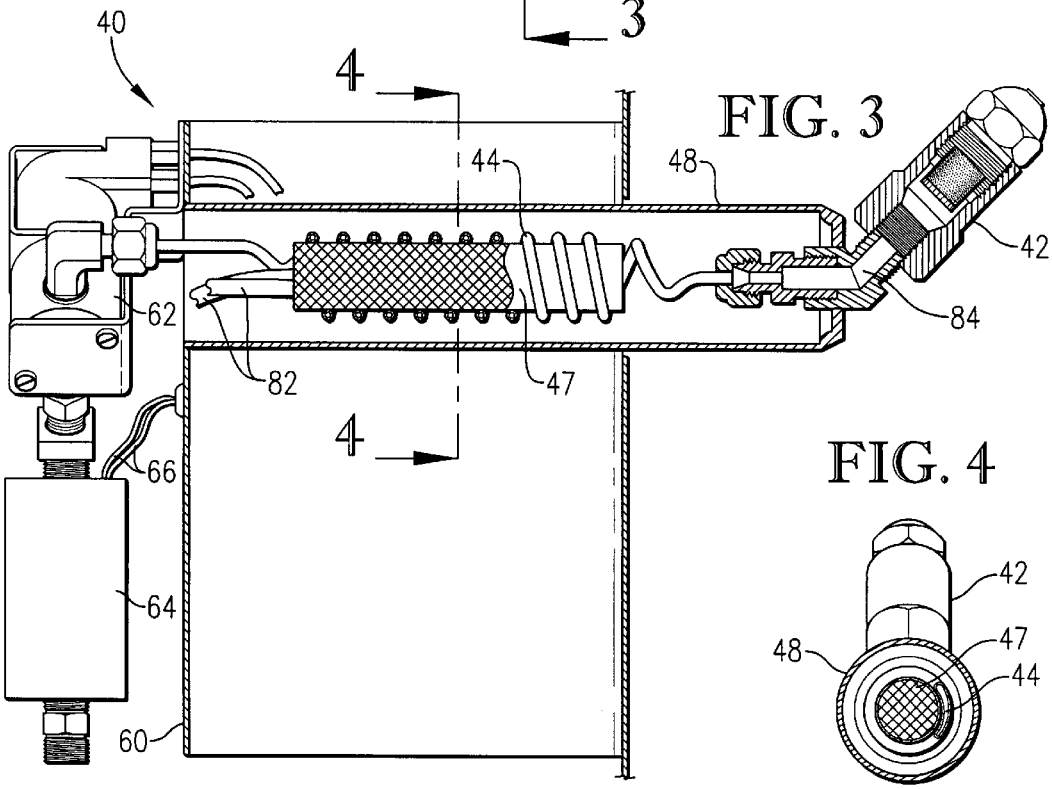
FIG. 4

STEAM HUMIDIFIER FOR FURNACES

TECHNICAL FIELD

1. Field of the Invention

This invention relates to humidifiers that are used in forced hot air heating systems. Specifically, this invention relates to an improved apparatus and method for introducing steam into a heated air stream in such a system.

2. Description of the Prior Art

It is well known that forced air heating systems tend to create an atmosphere in a building space characterized by low relative humidity which leads to occupant discomfort and possible health problems, damage to wooden articles including furniture contained within the building, and the discomfort caused by static electricity discharges. To obviate these problems, it is common practice to employ devices for adding moisture to the air being forced through the building space. In this regard, a wide variety of devices are commonly employed. For example, evaporative type systems are installed in the furnace plenum or heating ducts so that heated air is forced to flow through and about sponge-like members that are maintained in a moist condition by placing them in contact with a water reservoir. Such reservoirs must be maintained at a preset level to ensure sufficient moisture content in the sponge-like members. It is also known to utilize a steam generator in combination with a forced air heating system to place water vapor into the heated air stream. The steam is generated by use of a submerged heating element in a water reservoir tank. The water level must be maintained in such a tank at a predetermined level to keep the heating element submerged. Steam rises from the water level surface through a pipe or duct in communication with the forced air system and is thereby introduced into the heated air stream.

The systems of the prior art have several disadvantages. Systems that rely on evaporation also remove heat from the heated air in the system through the evaporation process, thus requiring additional energy to heat the serviced environment to the level demanded by the occupant or use. Furthermore, it has been found that steam mixes into the air stream better, providing a uniform water content in the heated air. These systems also rely on water reservoir tanks which have the disadvantages described below.

All of the known steam humidifiers rely on the use of a water reservoir tank or a city/utility provided source of steam. The water reservoir systems provide a tank of standing water that can be a breeding ground for bacteria, molds, and other unhealthy agents. Furthermore, water reservoir based systems cannot be run continuously because such systems must be periodically shut down to replenish water supply within the reservoir when it drops below a preset level.

While systems relying on steam generated by a city or utility overcome the aforementioned problems, such steam hookups are not widely available and are practically never provided for suburban residential use.

SUMMARY OF THE INVENTION

Accordingly, one important object of the present invention is to provide an improved steam humidifier unit for use with a forced air heating system.

In carrying out the foregoing and other objects, the present invention contemplates an improved method of generating steam to be injected into the forced air system. In its broadest respects, the invention contemplates a steam generator that connects to a continuous pressurized source of water such as a municipal water hookup, converts water supplied by the continuous pressurized source into steam and sprays that steam through a nozzle into the heated air system.

In one embodiment theater line connected to the continuous pressurized water source is controlled by a valve that opens in response to control circuitry, and a heating clement operates to convert water to steam only when water is flowing in the water line.

In another embodiment the water line connected to the continuous pressurized water source is controlled by a valve that opens in response to control circuitry, and a heating element operates to convert water to steam also in response to control circuitry wherein the heating element will be deactivated and the water valve will be closed if the heating element becomes too hot, the heater shuts down, or no more humidity is required.

In still another embodiment a heating and humidifying system having a return duct, a furnace, and a plenum is provided wherein a humidity sensor compares humidity in the return duct to a preset value and a thermostat compares the ambient temperature in the serviced room or building to a preset value. If both heat and humidity are demanded based on the preset values, a control valve causes water to flow from the continuous pressurized water source in heat transfer relationship with a heating element and the heating element is activated in response to the water flow and converts the water into steam which is then sprayed into the plenum of the furnace.

A method for controlling humidity is also disclosed including the steps of providing a heating system having a return duct, a furnace, and a plenum, sensing the humidity in the return duct, sensing the state of the furnace, causing water to flow through a water line when both humidity and heat arc required, heating the water thereby converting it to steam, and spraying the steam into the plenum of the furnace.

BRIEF DESCRIPTION OF THE DRAWINGS

A preferred embodiment of the present invention is described in detail below with reference to the attached drawing figures, wherein:

FIG. 2 is an enlarged, end elevational view of the humidifier;

FIG. 3 is a vertical cross-sectional view of the installed humidifier taken substantially along line 3—3 of FIG. 2;

FIG. 4 is a transverse cross-sectional view of the humidifier taken substantially along line 4—4 of FIG. 3;

DETAILED DESCRIPTION OF A PREFERRED EMBODIMENT

Figure 1:
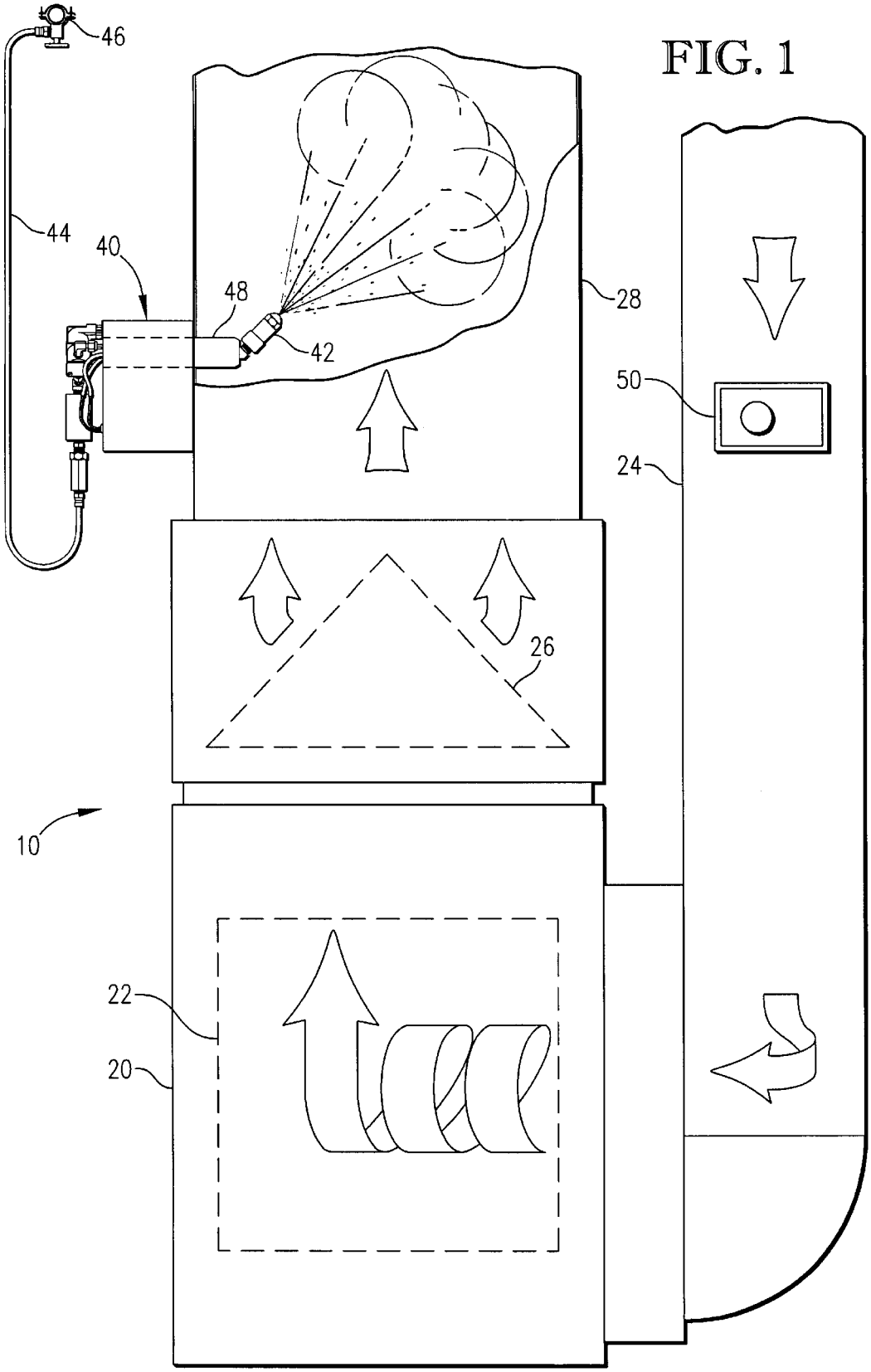
FIG. 1 is a side elevational view of a humidifier embodying the principles of the present invention mounted in a forced hot air heating system.

Referring to the drawings in greater detail, FIG. 1 depicts a heating and humidifying system 10 of the present invention including a heater 20 having a furnace 22, a return duct 24, air conditioning coils 26, and a plenum 28. Mounted to heater 20 30 is humidifier 40. Humidifier 40 includes a nozzle 42 mounted so as to protrude into the plenum 28 of the heater 20. The nozzle 42 is in communication with a water line 44 that is connected to a continuous pressurized water source 46. The continuous pressurized water source 46 may come from, for example, a household water connection whose source may be a municipal water utility, a well, or any other convenient source of pressurized water. The water source used may be either cold or hot water, but is preferably a cold water source so as to avoid placing further demands on the hot water system contained within the building being serviced by the system of the present invention. The water line passes in close proximity to a heating element 47 (FIG. 3) that is mounted within an insulating barrier 48 which surrounds both heating element 47 and that portion of the water line 44 that is proximate to heating element 47. Mounted within the return duct 24 is a humidity sensor 50, preferably a humidistat, that is used to sense the humidity of the air returning to the furnace from the area serviced by the furnace. When the humidity of the air in the return duct is lower than a predetermined limit, the humidity sensor sends a signal to the humidifier which will cause, as more particularly described below, the humidifier to generate steam for use in the hot air stream of the system.

Reference is now made to FIG. 2 which shows an end elevation view of a preferred embodiment of the humidifier 40. A generally U-shaped metallic bracket 60 is provided for mounting the components used to generate steam. Mounted to the bracket 60 is a solenoid operated water control valve 62. The control valve 62 is fitted so as to control the flow of water in the water line 44 from the continuous pressurized water source 46. A water flow sensor 64 is mounted on the water line and communicates power through lines 66 to the heating element 47 (FIG. 3) of the steam generating unit. The bracket also has mounting holes 68 for mounting the bracket to the plenum 28.

Figure 5:
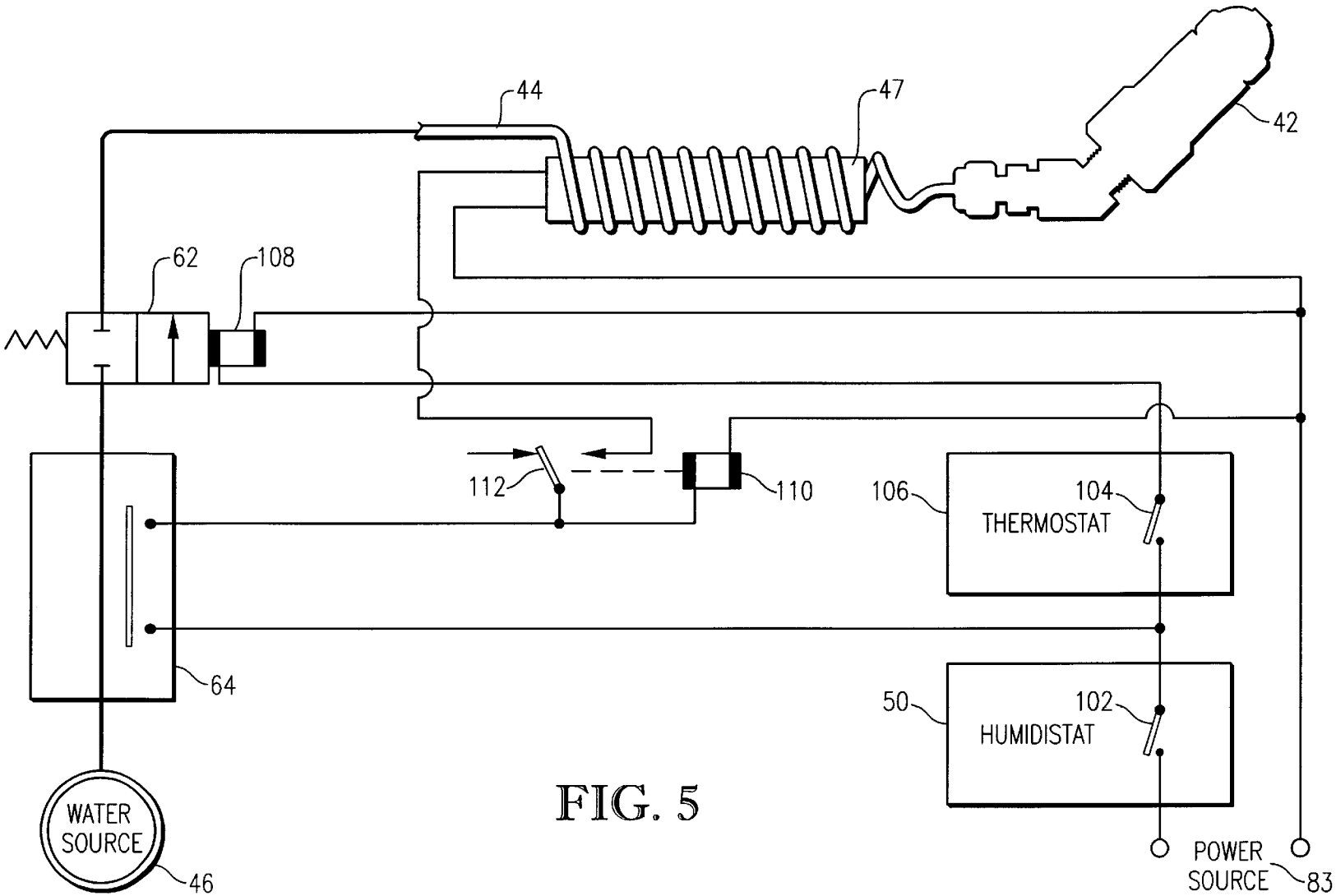
Fig. 5 is a schematic view showing the control circuitry of a preferred embodiment of the invention.

FIG. 3 shows a vertical cross-sectional view of the installed bracket 60 and the steam generating unit of FIG. 2. Heating element 47 has two power lines 82 for coupling it to a power source 83 (FIG. 5). In one embodiment, heating element 47 is 3" long with a ⅝" diameter rated at 200 watts and is made by Watlow, Inc. The water feed line 44 is coiled about the heating element 47. The coiled portion of the water line 44 may be made of any heat conducting material, but it has been found that stainless steel works best. In the preferred embodiment, the coil is made from a ⅛" stainless steel tube, also known as #316 stainless steel. In a preferred embodiment there are 10 coils for every 3 inches, or 3.33 coils per inch. The coiled portion of the water line 44 and the heating element 47 are surrounded by the insulation barrier 48, preferably a schedule 5 stainless steel insulation tube. The insulation barrier 48 reflects heat that passes between the coils of the water line 44 back onto the water line, thereby compensating for any cooling of the heating element surface caused by the flow of water within the water line. Alternatively, the insulation barrier may be removed if control circuitry is provided to ensure that the heating element maintains a sufficient temperature to provide for the continuous production of steam. The water line 44 is fitted to the nozzle 42, which nozzle is mounted to the insulation barrier 48. The nozzle 42 has an interior chamber 84 having a greater diameter than the diameter of water line 44 where it is fitted to the nozzle 42. It is believed that the hot water is vaporized within the chamber 84 due to the relatively lower pressure within the chamber compared to pressure within the water line 44 as it passes around the heating element 80. Vaporization within the chamber 84 prevents vapor lock in the water line 44. In one embodiment, nozzle 42 is a 0.37 GPH type 416 stainless steel nozzle made by Hago Manufacturing, Inc. The insulation barrier 48 is welded to the bracket 60.

FIG. 4 shows a cross section of the heating element 47, water line coil 44, and insulation barrier 48. It can be seen that the water line coil 44 is preferably in direct contact with the heating element 47 to maximize conduction of heat to the coil and thereby to water flowing within the coil. As described above, heat that escapes from the surface of the heating element 80 between the coils of the water line 44 will be reflected back onto the water line coil by the insulation barrier 48. This heat reflection will ensure that the coil is sufficiently heated to generate the steam.

FIG. 5 shows a schematic diagram of the control circuitry of a preferred embodiment of the invention. Power source 83 is an AC power source, preferably 120 volts, for supplying power to the humidifier. The humidity sensor 50, preferably an humidistat, is used to control a switch 102. The switch 102 is connected in series with a second switch 104, which is controlled by a thermostat 106. The thermostat 106 is used to set the desired heating level in the building or room serviced by the heater 20. The humidistat 50 is set to a predetermined value to provide a comfortable level of humidity in the room or building being serviced by the system. When the humidity level sensed in the return duct is less than the predetermined limit set for the humidistat, the humidistat will close the switch 102 controlled by it. When more heat is required, the thermostat will close the switch 104 controlled by it. When both switches 102, 104 are closed, the solenoid 1 08 will be actuated and open the water control valve 62. Once the water control valve 62 is open, water will flow in the water line and that water flow will be detected by a water flow sensor 64, preferably a water flow switch. In a preferred embodiment, the water flow switch will be preset to turn on once water flow approaches the maximum flow rate of the nozzle 42. When this occurs, the water flow switch will close, actuating a relay 110 which then closes a switch 112 turning on the heating element 47.

Figure 6:
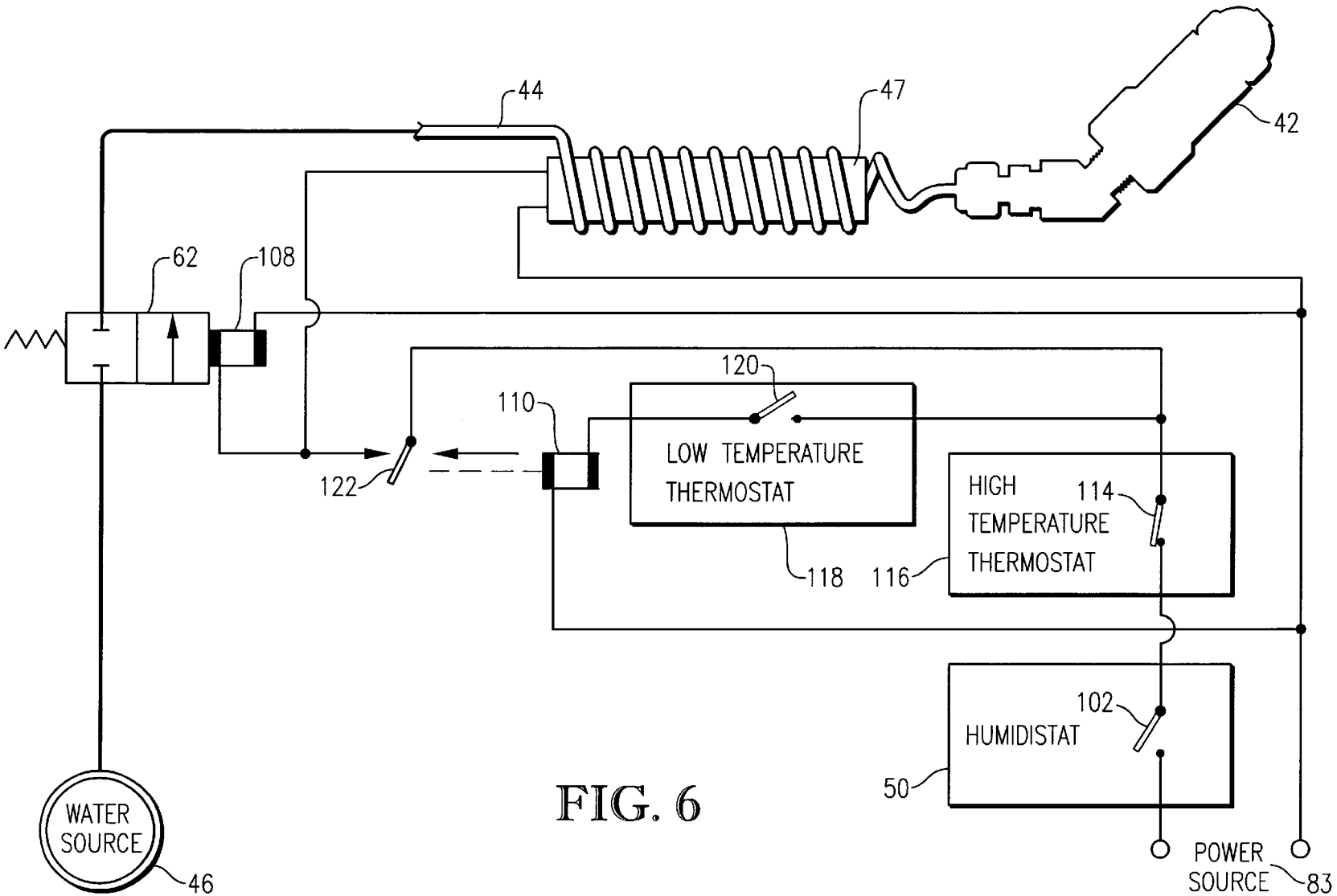
FIG. 6 is a schematic view showing the control circuitry of a preferred embodiment of the invention.

FIG. 6 shows an alternative configuration for controlling the humidifier 40. In this embodiment, humidistat 50 again controls switch 102 as in FIG. 5. Switch 102 is connected in series with normally closed switch 114. Switch 114 is controlled by a high temperature thermostat 116 which is measuring the temperature of the heating element at the exterior of insulation barrier 48. In this alternative embodiment, the thermostat is preferably set to open switch 114 when the temperature measured by it at the exterior of insulation barrier 48 exceeds 300° F. Low temperature thermostat 118 measures the temperature of ambient air in the plenum 28 and controls switch 120. In this alternative embodiment, low temperature thermostat 118 is preferably set to close switch 120 when the ambient air within plenum 28 exceeds 100° F. in temperature. Relay 110 controls single pole normally open switch 122 and is coupled so that it will close switch 122 only when humidity is required, the heating element has not exceeded in temperature a predetermined limit, and the ambient air in plenum 28 has exceeded a predetermined limit in temperature. When all three conditions have occurred, relay 110 will close switch 122 energizing heating element 47 and actuating solenoid 108 to open water control valve 62.

It will be understood that a system using the control embodiment of FIG. 5 works as follows. When the ambient temperature in the room or building being serviced by the heating and humidifying system falls below a preset level, the thermostat 106 will send a signal to turn on the heater. Simultaneously the thermostat will close the switch 104. If the heater is thus demanded by the thermostat and the humidity sensed in the return duct is below the predetermined level, the humidistat 50 within the return duct will close the switch 102. If both the switches 102, 104 are closed, the solenoid 108 is actuated causing the water control valve 62 to open. Water then flows from the continuous pressurized water source 46 through the water line 44. When the water flow approaches the maximum output rate of the nozzle 42, the water flow switch 64 will close, actuating the relay 110. The relay 110 closes the switch 112 that turns on the heating element 47. As water passes through the coil 44 around the heating element 47, water is heated increasing the pressure and temperature of the water within the coil. When the water leaves the coil and enters the larger diameter chamber 84 of the nozzle 42, the release in pressure causes the water to vaporize and become steam. The steam is then sprayed by the nozzle 42 into the plenum 28 of the heater where it mixes with hot air exiting the furnace 22 and increases the humidity of the air being sent to the heated room or building. The steam humidifier will continue to operate until the ambient humidity in the return duct reaches the preset level, or until the thermostat senses no more heat is required, whichever occurs first. Once either condition occurs, the solenoid 108 will be deactivated resulting in the water control valve closing. Water flow will cease and the water flow switch 64 will open disconnecting the heating element 47 from the power source 100.

Using the alternative control configuration disclosed in FIG. 6, the system operates as follows. If the heater 40 is operating it will heat air that is forced through plenum 28. When the ambient temperature of the heated air in plenum 28 exceeds 100° F. low temperature thermostat 118 will close switch 120. Simultaneously, humidistat 50 operates as described previously, and will close switch 102 when more humidity is required in the area being serviced by the system. Switch 114 is normally closed and given these conditions relay 110 will close switch 122 which simultaneously energizes heating element 47 and actuates solenoid 108 opening water control valve 62 and causing water to flow towards the heating element. Water within water line 44 gets converted to steam and sprayed out of nozzle 42 into the plenum 28 of the heater 40 as described above. High temperature thermostat 116 acts as a safety device to ensure that heating clement 47 does not exceed a predetermined limit and possibly create a dangerous situation. If high temperature thermostat 116 senses temperature greater than 300° F. at the exterior surface of insulation barrier 48, then it will open normally closed switch 114 cutting power to heating element 47 and deactivating solenoid 108 which causes water control valve 62 to close. Thus the system will be shut down. Likewise, the system will be shut down if the humidity in return duct 24 exceeds the predetermined limit set for humidistat 50 or if heater 40 turns off decreasing the temperature of the ambient air in plenum 28 below 100° F. causing low temperature thermostat 118 to open switch 120. Either condition will deactivate relay 110 and single pole normally open switch 122 will open cutting power to heating element 47 and deactivating solenoid 108 as previously described.

By providing a system that can generate steam supplied by a continuous pressurized water source such as found in an ordinary home, we have overcome the problems of the prior art systems that relied on reservoir tanks, and have provided the advantages of steam injected systems that have access to steam lines generated by city hookups or utilities.

Although preferred forms of the invention have been described above, it is to be recognized that such disclosure is by way of illustration only and should not be utilized in a limiting sense in interpreting the scope of the present invention. Modifications to the exemplary embodiments, as herein above set forth, could be readily made by those skilled in the art without departing from the spirit and scope of the claims.

The inventors hereby state their intent to rely on the Doctrine of Equivalence to determine and assess the reasonably fair scope of their invention as pertains to any apparatus or method not materially departing from but outside the literal scope of the invention as set out in the following claims.

We claim:

1. In a heating and humidifying system having a return duct, a furnace, and a plenum:

a humidity sensor within said return duct for sensing ambient humidity;

a heat sensor for controlling said furnace;

a steam nozzle protruding into said plenum for injecting steam into heated air;

a water line connected between a continuous pressurized water source and said steam nozzle;

a control valve in the path of said water line, said control valve opening in response to signals from said humidity sensor and from said heat sensor so that water will flow in said water line when said furnace is on and more humidity is required;

a water flow sensor coupled to said water line for detecting water flow in said water line; and a heating element proximate to said water line for converting water within said water line into steam, said heating element being energized in response to a signal from said water flow sensor.

2. The heating and humidifying system of claim 1 wherein said water line includes a coiled portion wrapped around said heating element.

3. The heating and humidifying system of claim 2 wherein said coiled portion of said water line comprises stainless steel.

4. The heating and humidifying system of claim 1 further including an insulation barrier substantially surrounding said heating element and part of said water line.

5. The heating and humidifying system of claim 4 wherein said insulation barrier comprises stainless steel.

6. The heating and humidifying system of claim 1 wherein said humidity sensor is a humidistat.

7. The heating and humidifying system of claim 1 wherein said heat sensor is a thermostat.

8. The heating and humidifying system of claim 1 wherein said water flow sensor is a water flow switch.

9. In a heating and humidifying system having a furnace and a plenum:

a steam nozzle presenting a constriction and protruding into said plenum for injecting steam into heated air;

a water line connected between a continuous pressurized water source and said steam nozzle; and a heating element proximate to said water line for converting water within said water line into steam, said heating element comprising an elongated, electrically powered element that becomes hot when supplied with electrical energy, said water line including a coiled portion that includes a plurality of coils wrapped around and extending along said element in disposition to receive heat from said clement by conduction and progressively raise the temperature of the flowing water as it travels in the coils along the length of the element until the water changes to steam before being discharged from the nozzle.

10. The heating and humidifying system of claim 9 wherein said coiled portion of said water line comprises stainless steel.

11. The heating and humidifying system of claim 9 further including an insulation barrier substantially surrounding said heating element and said coiled portion of said water line, said insulation barrier comprising an elongated tube receiving said heating element and said coiled portion of the water line in radially spaced relation thereto.

12. The heating and humidifying system of claim 11 wherein said insulation barrier comprises stainless steel.

13. The heating and humidifying system of claim 9 wherein said coils of the water line are in direct contacting engagement with said heating element.

14. The heating and humidifying system of claim 13 wherein said heating element is cylindrical presenting an outer surface that is circular in transverse cross section, said coils of the water line being circular in transverse cross section and lying in complemental engagement with the outer surface of the heating element.

15. The heating and humidifying system of claim 9 further including an enlarged chamber in flow communication with the water line between the coils of the water line and the constriction oft he nozzle, said enlarged chamber having a cross-sectional dimension exceeding that of the water line in said coiled portion.

* * * * *